United States Patent [19]

Kobayashi et al.

[11] Patent Number: 4,570,044

[45] Date of Patent: Feb. 11, 1986

[54] INDUCTION HEATING AND FIXING DEVICE FOR A COPYING MACHINE

[75] Inventors: Toshiaki Kobayashi, Tenri; Noriaki Sakamoto, Nara, both of Japan

[73] Assignee: Sharp Kabushiki Kaisha, Osaka, Japan

[21] Appl. No.: 486,494

[22] Filed: Apr. 19, 1983

[30] Foreign Application Priority Data

| | | | |
|---|---|---|---|
| Apr. 23, 1982 | [JP] | Japan | 57-69404 |
| Apr. 23, 1982 | [JP] | Japan | 57-69405 |
| Apr. 23, 1982 | [JP] | Japan | 57-69406 |

[51] Int. Cl.[4] ..... H05B 5/00; H05B 6/00; H05B 9/00

[52] U.S. Cl. ..... 219/10.49 A; 219/10.49 R; 219/10.57; 219/216; 219/469; 355/3 FU; 355/14 FU

[58] Field of Search ..... 219/10.49 A, 10.49 R, 219/10.57, 10.75, 10.79, 216, 469, 470, 471; 355/3 FU, 14 FU; 432/59, 60

[56] References Cited

U.S. PATENT DOCUMENTS

| | | | |
|---|---|---|---|
| 4,229,644 | 10/1980 | Namiki et al. | 219/469 |
| 4,284,875 | 8/1981 | Namiki et al. | 219/216 |
| 4,329,565 | 5/1982 | Namiki et al. | 219/216 |
| 4,365,139 | 12/1982 | Dannatt | 219/216 |
| 4,435,072 | 3/1984 | Adachi et al. | 355/3 FU |
| 4,456,368 | 6/1984 | Isaka et al. | 355/3 FU |

*Primary Examiner*—C. L. Albritton
*Assistant Examiner*—M. M. Lateef
*Attorney, Agent, or Firm*—Birch, Stewart, Kolasch & Birch

[57] ABSTRACT

An induction heating and fixing device suitable for a copying machine comprises a fixing roller, a first iron core, a second iron core, and two third iron cores. The first iron core inserted into the center of the fixing roller. The first, the second, and the third iron cores are magnetically and mechanically combined together to form a closed magnetic circuit. Magnetic blocks are provided for combining the first, the second, and the third iron cores. Each of these iron cores comprises a plurality of isolated thin silicon steel plates. At least one of the two of the third iron cores is disassembled to remove the fixing roller from the device for maintenance.

11 Claims, 16 Drawing Figures

FIG.7(a-1)
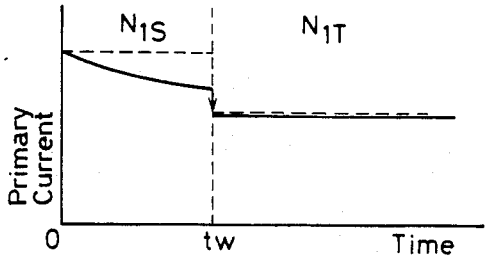
FIG.7(b-1)
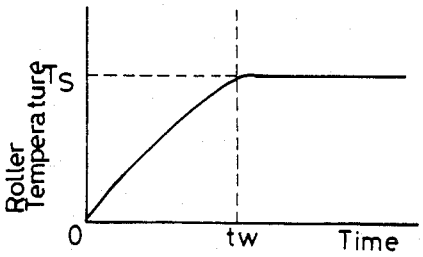
FIG.7(a-2)
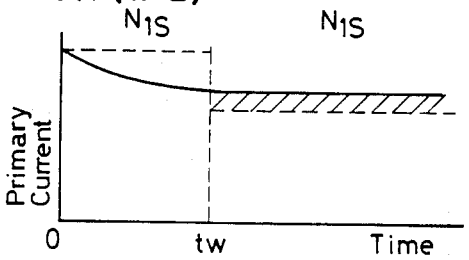
FIG.7(b-2)
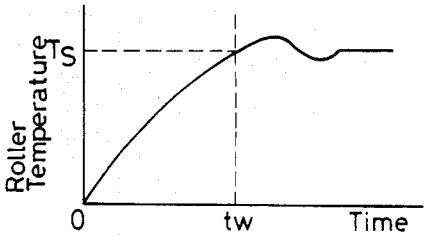
FIG.7(a-3)
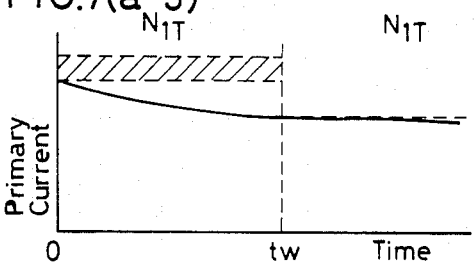
FIG.7(b-3)
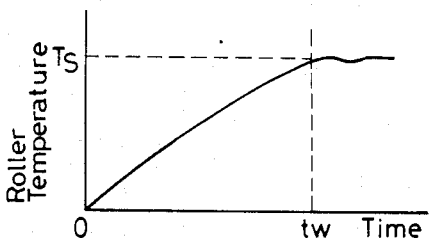

INDUCTION HEATING AND FIXING DEVICE FOR A COPYING MACHINE

BACKGROUND OF THE INVENTION

The present invention relates to a copying machine and, more particularly, to an induction heating and fixing device suitable for any copying machine such as an electrophotographic or a xerographic copying machine for fixing toner images on a copy paper using induction heating.

Conventionally, induction heating devices have been applied to the cotton spinning machines. The induction heating devices comprise heating rollers for causing heating on their surfaces. The induction heating devices are superior to other conventional rollers because heating is caused on the surfaces of the heating rollers, the heating rollers thus can be heated in a short time. Since this feature is suitable for an electrophotographic or a xerographic copying machine, it may be desirable to apply the heating devices to copying machines. However, because the heat distribution on the roller surface is not uniform the primary coil must be heated too much to assure the coil insulation, so that copper loss of the coil increases.

Therefore, conventional induction heating devices have not been directly applied to copying machines.

SUMMARY OF THE INVENTION

Accordingly, it is an object of the present invention to provide an improved copying machine equipped with an improved induction heating and fixing device.

It is another object of the present invention to provide an improved induction heating and fixing device suitable for a copying machine.

It is a further object of the present invention to provide an improved induction heating and fixing device comprising a closed magnetic circuit suitable for an electrophotographic or a xerographic copying machine.

Briefly described, in accordance with the present invention, an induction heating and fixing device suitable for an electrophotographic or a xerographic copying machine comprises a fixing roller means, some magnetic members, and coils. The magnetic members form a closed magnetic circuit for induction heating the fixing roller. The fixing roller has its surface made of a conductive member. The magnetic members comprise at least three magnetic members each comprising a plurality of thin insulated silicon steel plates. The first magnetic member is inserted inside the fixing roller. The coils are wound around the first magnetic member, being energized by an AC power voltage. While the second magnetic member is positioned over the fixing roller, a set of the third members are interposed between the first and the second magnetic members. Three magnetic blocks are provided for magnetically and mechanically combining the first, the second and third magnetic members.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIGS. 7(*a*-1) to 7(*a*-3) show graphs representing the relations between coil numbers and primary currents;

FIGS. 7(*b*-1) to 7(*b*-3) show graphs representing the relations between coil numbers and roller temperatures;

DESCRIPTION OF THE INVENTION

Figure 1:
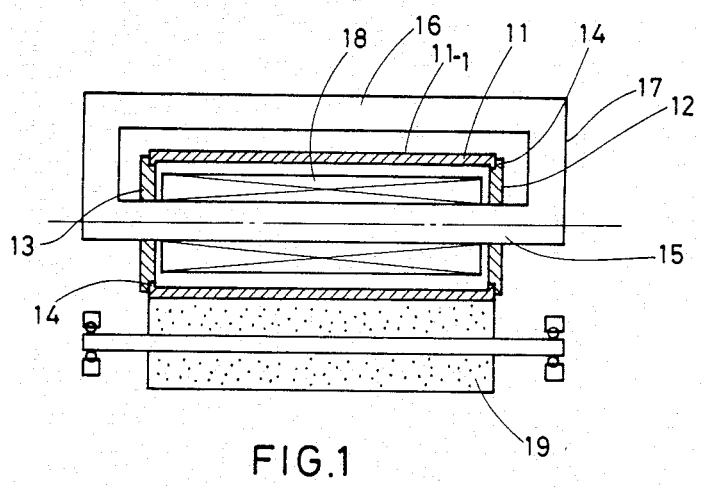
FIG. 1 shows a cross sectional view of a typical induction heating and fixing device adapted for a copying machine.
Figure 2:
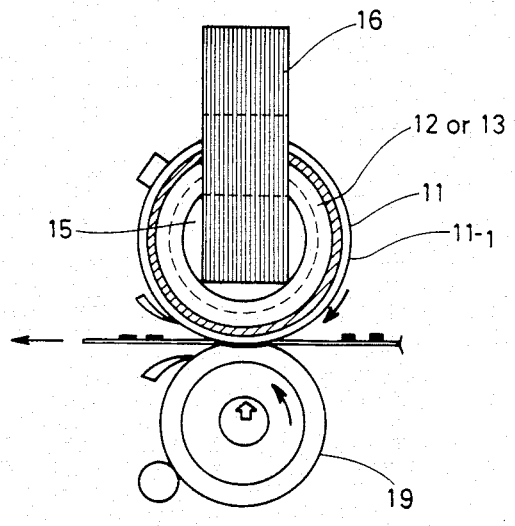
FIG. 2 shows a side view of the induction heating and fixing device of FIG. 1.
Figure 3:
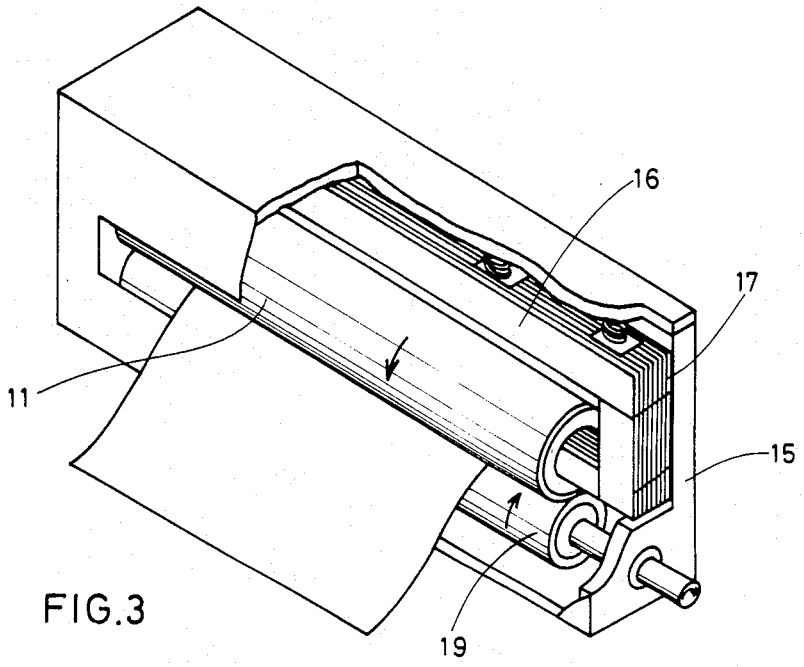
FIG. 3 shows a perspective view of the device of FIG. 1.

FIG. 1 shows a typical induction heating and fixing device adapted for an electrophotographic or a xerographic copying machine used to describe the principle of the present invention. FIGS. 2 and 3 show a side view and a perspective view of the device of FIG. 1, respectively.

With reference to these drawings, the typical induction heating and fixing device comprises a cylindrical roller 11 with a surface 11-1, roller supporters 12 and 13, bearings 14, a rectangular iron core 15, a magnetic member 16, coils 18, and a pressing roller 19.

The cylindrical roller 11 is made of a conductive material. To provide the surface 11-1, the roller 11 is coated with a synthetic resin, such as Teflon. The roller 11 is rotatably supported by the roller supporters 12 and 13 via the bearings 14. The iron core 15 is inserted into the roller supporters 12 and 13 and the roller 11. The roller supporters 12 and 13 are fixed to the iron core 15. The iron core 15 is laminated with a plurality of silicon steel plates each made of a magnetic material having a high permeability. To the ends of the iron core 15, the magnetic member 16 is connected which is made of a similar material to the iron core 15, to form a closed rectangular magnetic circuit 17. The coils 18 are wound around the iron core 15 within the center of the roller 11. The coils 18 are energized by an AC power voltage. The pressing roller 19 confronts the roller 11 to stress a paper inserted therebetween. The pressing roller 19 is made of a silicone rubber.

The coils 18 are energized to induce an AC flux for passing through the closed magnetic circuit 17 including the core 15 and the member 16. When the resultant magnetic flux penetrates the roller 11 to thereby provide an eddy current, the roller 11 is heated. Further, the conductive roller 11 functions as a coil with a single turn, so as to induce a current. This induced current and the resistance of the roller 11 serves in combination, to heat the roller 11.

According to the typical induction and fixing device as shown in FIGS. 1 to 3, the following disadvantages are present:

(a) Although the roller 11 is directly heated to thereby promptly increase its temperature, the temperature-rising feature is not sufficient and a high electric power is required.

(b) To provide the closed magnetic circuit 17 showing a small loss, the magnetic return member 16 must be large.

(c) Because the closed magnetic circuit 17 is provided with the iron core 15 of laminated steel plates and the joints of the closed magnetic circuit 17 are provided with the laminated steel plates, the assembled device cannot be readily overhauled to replace the old roller 11. Thus, poor maintenance and productivity are achieved;

(d) Although it may be possible to compose the closed magnetic circuit 17 of some magnetic blocks to resolve the problem of (c), iron loss (eddy current loss) becomes remarkably large, accordingly.

In accordance with the present invention, all of the above problems (a) to (d) are resolved.

Figure 4:
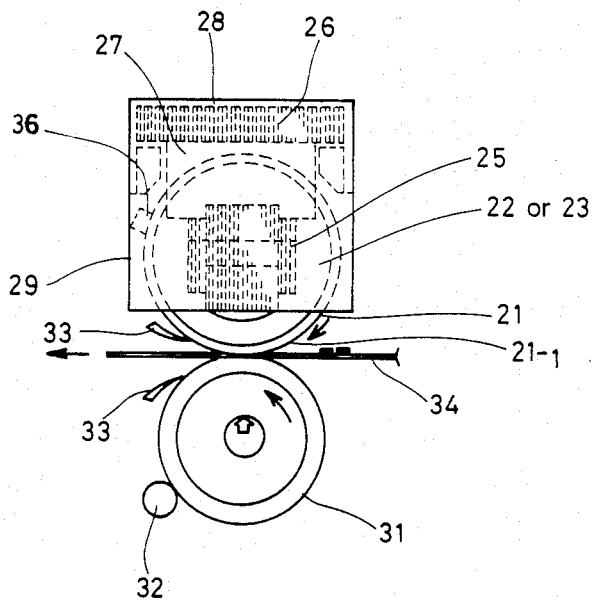
FIG. 4 shows a side view of an induction heating and fixing device suitable for an electrophotographic or a xerographic copying machine according to the present invention.
Figure 5:
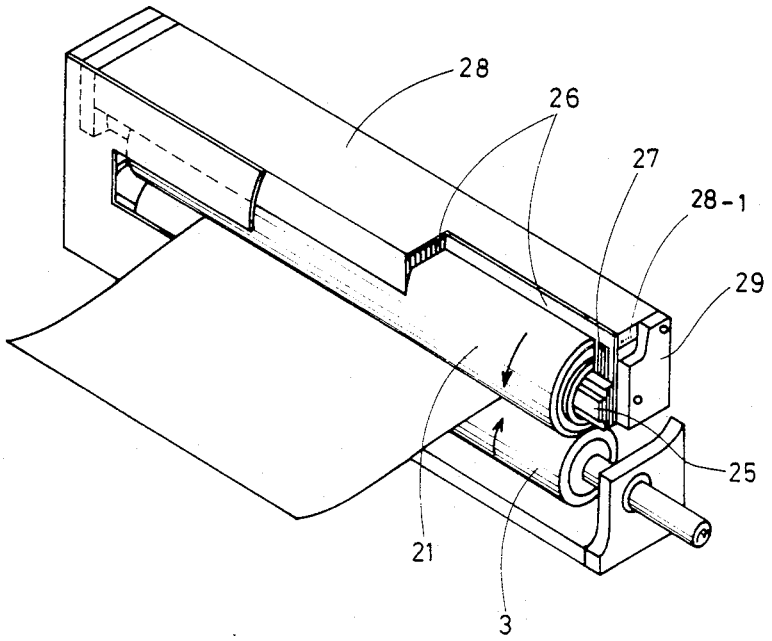
FIG. 5 shows a perspective view of the device of FIG. 4.

FIG. 4 shows a side view of an induction heating and fixing device according to the present invention. FIG. 5 shows a perspective view of the device of FIG. 4.

With reference to these drawings, the induction heating and fixing device of the present invention comprises a cylindrical roller 21, roller supporters 22 and 23, two iron cores 25 and 26, a set of third iron cores 27, a magnetic block 28, a set of magnetic blocks 29, coil 30 (FIG. 6) pressure roller 31, a cleaning roller 32, two paper separation claws 33, and a temperature sensor 36.

The roller 21 is composed of a conductive material. The roller 21 is coated with a synthetic resin such as Teflon. Roller 21 is rotatably supported by the bearings to the supporters 22 and 23. The first, second, and third iron cores 25, 26, and 27 are magnetically and mechanically combined together to form a closed magnetic circuit according to the present invention. The first iron core 25 is inserted into the roller 25 and the supporters 22 and 23. The second iron core 26 is positioned over the roller 25. Each of the third iron cores 27 is positioned at the two sides of the roller 25. The supporters 22 and 23 are fixed to the first iron core 25. The iron core 25 is laminated with a plurality of thin silicon steel plates having a high permeability. The second iron core 26 is also laminated with a plurality of silicon steel plates similar to the first iron core 25.

To reduce unnecessary space of the device, the height of the second iron core 26 is less than that of the first iron core 25 and, the width of the second iron core 26 is greater than that of the first iron core 25. The third iron cores 27 are provided for magnetically connecting the first and second iron cores 25 and 26. The third iron cores 27 are laminated with a plurality of thin silicon steel plates similar to the first iron core 25. The third iron cores 27 are mechanically engaged with the first iron core 25 and the second iron core 26 with the help of the magnetic blocks 29.

The second iron core 26 and the third iron cores 27 are screwed to the magnetic blocks 28 and 29, respectively. The two blocks 28 and 29 are rather thick. The ends 28-1 of the magnetic block 28 are bent in which there are provided apertures for fastening the block 28 to the third iron cores 27. The magnetic blocks 28 and 29 serve to magnetically connect the iron cores 25, 26, and 27. In addition, they serve to supplement the closed magnetic circuit. The magnetic circuit is closed with a loop including the first iron core 25, the second iron core 26, and the third iron cores 27. When at least one of the third iron cores 27 at the two sides is removed, the roller 21 can be removed from the assembled device.

The coil 30 (FIG. 6) is wound around the first iron core 25 within the roller 21 for functioning as the primary coil. The coil 30 is energized by an AC power voltage. The coil 30 is detachably connected with the first iron core 25.

The presser roller 31 confronts the roller 21 to grasp a copy paper for fixing a toner image thereon. The surface of the presser roller 31 is composed of silicone. The cleaning roller 32 is provided for cleaning the surface of the presser roller 31 by being in contact with the surface thereof. The claws 33 are provided for scraping a copy paper 34 from the rollers 21 and 31. The copy paper 34 is forwarded from an image forming section including a transfer section. The temperature sensor 36 is provided for sensing the roller temperature to detect a toner-fixing temperature.

According to the arrangement, the closed magnetic circuit is formed with the first core 25, the third iron cores 27, and the second iron core 26. The primary coils 30 are wound around the first iron core 25. The third iron cores 27 and the magnetic blocks 29 are overlapped to form a double layer. The second iron core 26 and the magnetic block 28 are overlapped to form a double layer. At the two sides of the first iron core 25, the magnetic blocks 29 are positioned for fixing the second iron cores 27. It may be possible to replace the magnetic blocks 29 by fixing angles, or fixing blocks both made of a heat resisting material. The second iron cores 27 can be removed by disassembling the magnetic blocks 29.

The upper magnetic block 28 forms a U-shape to grasp the second iron core 26. Since the second iron core 26 is screwed, at the bent portion 28-1, to the magnetic blocks 29, it may be possible to separate the second iron core 26 and the third iron cores 27. The third iron cores 27 are also screwed to the magnetic blocks 29. Hence, the closed magnetic circuit includes removable screws, so that the roller 21, inside the closed magnetic circuit, can be easily removed. The iron loss of the magnetic blocks 28 and 29 can be minimized. The reason is as follows:

Virtually all magnetic flux flows through the closed magnetic circuit, as formed with the second iron core 26 and the third iron cores 27, which are composed of the insulated thin plates positioned inside return portions of the closed magnetic circuit, but does not flow through the magnetic blocks 28 and 29, which are rather thick. The magnetic blocks 28 and 29 serve to prevent magnetic saturation or reduce the flux leakage. The second iron core 26 and the third iron cores 27 are all laminated so as to conduct the magnetic flux smoothly. To reduce the magnetic resistance of the joints between the cores 25, 26 and 27, they are fastened together tightly.

Figure 6:
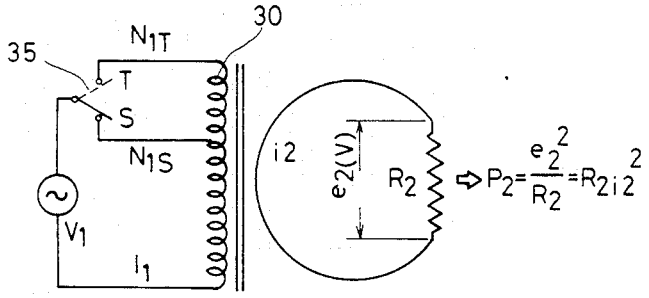
FIG. 6 shows an equivalent circuit of the device of FIG. 4.

FIG. 6 shows an equivalent circuit of the induction heating and fixing device of the present invention.

The number of turns (N) of the primary coils 30 is determined by the power source, for example with FIG. 6, two in respect to a single commercial power source, so that the temperature of the roller 21 promptly rises. The number of turns of the coil 30 is set, so that $N1T > N1S$. Before the roller temperature reaches a toner-fixing temperature at which the toner image can be fixed to the paper, a switch 35 is connected to a terminal S. Thereafter, the switch 35 is connected to a terminal T.

That is, before the roller temperature is lower than the toner-fixing temperature, an AC power source V1 is connected to wirings N1S(N1T) to provide power to the roller 21 corresponding to a secondary side of a transformer. After the roller temperature reaches the toner-fixing temperature, the AC power source V1 is connected to wirings N1T to reduce power consumed by the fixing device. The temperature sensor 36 is provided for sensing the roller temperature to detect the toner-fixing temperature. Responsive to the detection of the temperature sensor 36, the switching between the wirings N1S and N1T is enabled.

FIGS. 7(*a*-1) to 7(*a*-3) and 7(*b*-1) to (*b*-3) show the relations between the primary currents and the roller temperatures vs. time. The dotted lines of FIGS. 7(*a*-1) to 7(*a*-3) represent maximum primary currents which can be employed. A time tw is needed to reach at the toner-fixing temperature of the roller 21.

FIGS. 7(*a*-1) and 7(*b*-1) show the relations with the induction heating and fixing device according to the present invention. FIG. 7(*a*-1) shows that the primary current is remarkably reduced within the current limitation. FIG. 7(*b*-1) shows that the roller temperature is promptly heated. As the roller temperature is heated, the necessary primary current is reduced.

The relations of FIGS. 7(*a*-1) and 7(*b*-1) are superior in that the maximum of the rated current of the commercial power source is limited and that the fixing device should consume reduced power because the copying machine consumes power for components other than the fixing device.

FIGS. 7(*a*-2) and 7(*b*-2) are related to the case where the primary coils are selected as a single wiring N1S.

FIG. 7(*b*-2) shows that the roller temperature promptly increses. To the contrary, FIG. 7(*a*-2) shows that the primary current is larger than the limited current of FIG. 7(*a*-1) at the hatched zone. This is impracticable.

If the single wiring N1S is solely provided, the thickness of the roller 21 must be very thin, so that good operation cannot be assumed when a paper fixing operation takes place within the fixing device, which is impracticable.

FIGS. 7(*a*-3) and 7(*b*-3) are related to the case where a single wiring N1T is solely provided by setting the wiring N1T to satisfy the current limitation steady.

FIG. 7(*a*-3) shows that the primary current is much smaller than the limited current of FIG. 7(*a*-1). The hatched portions of FIG. 7(*a*-3) represent current which is much limited upon the connection of the power source. Therefore, FIG. 7(*b*-3) shows that the rising of the roller temperature is not prompt, being later than the case of FIG. 7(*b*-1).

The closed magnetic circuit of the present invention satisfies the following advantages:

(1) The closed magnetic circuit enables the roller 21 to receive a maximum current which is available depending on the commercial power source and the condition of the power source. Therefore, the roller 21 can be heated promptly.

(2) The closed magnetic circuit is easily assembled with screws. The circuit comprises a plurality of thin isolated silicon steel plates.

(3) The roller 21 is coated with a suitable synthetic resin to prevent off-set. Since the life time of the coated roller 21 is limited, the coating must be replaced for maintenance. For this purpose, part of the closed magnetic circuit, preferably, the sides, should be capable of being disassembled.

(4) Thick magnetic blocks are suitable for being disassembled. However, the thick magnetic blocks provide much eddy current loss (iron loss) more than the thin magnetic blocks. Thus, the thick magnetic blocks are not suitable to reduce the eddy current loss.

(5) The second iron core 26 for returning the magnetic flux is as compact and thin as possible to make the device compact.

(6) The closed magnetic circuit is connected with a low magnetic resistance, so that the magnetic flux can pass smoothly.

Figure 8:
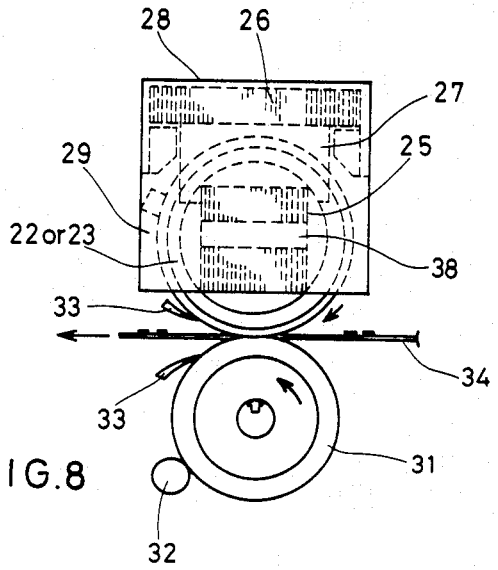
FIG. 8 shows an induction heating and fixing device according to another form of the present invention.

FIG. 8 shows another preferred form of the induction heating and fixing device according to the present invention. Since FIG. 8 is indentical with FIG. 4, like elements corresponding to those are represented by like numerals except that two blocks 38 are additionally provided in FIG. 8.

Figure 9:
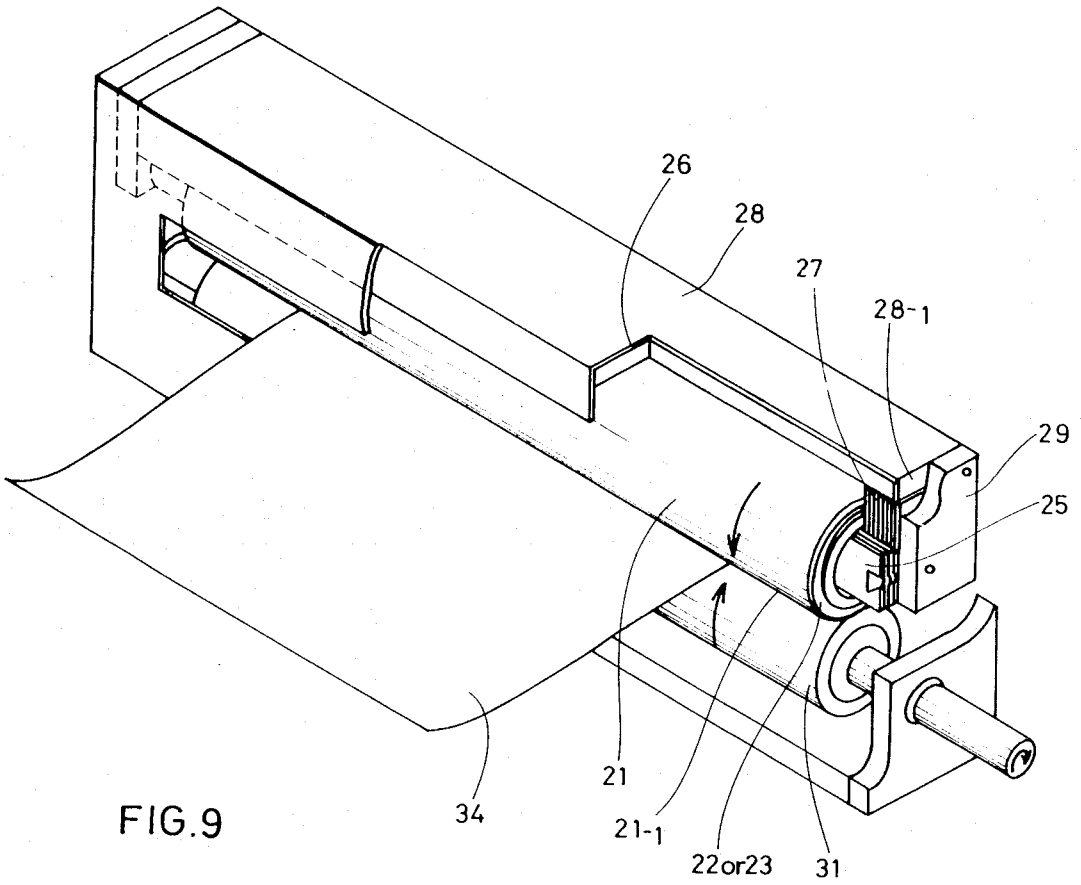
FIG. 9 shows a perspective view of the device of FIG. 8.

FIG. 9 shows the device of FIG. 8 in a perspective view. The bent portion 28-1 of the magnetic block 28 is combined with the magnetic block 29 with some screws. At this time, the lower portions of the second iron core 26 and the upper portions of the third iron cores 27 are magnetically and mechanically engaged.

Figure 10A:
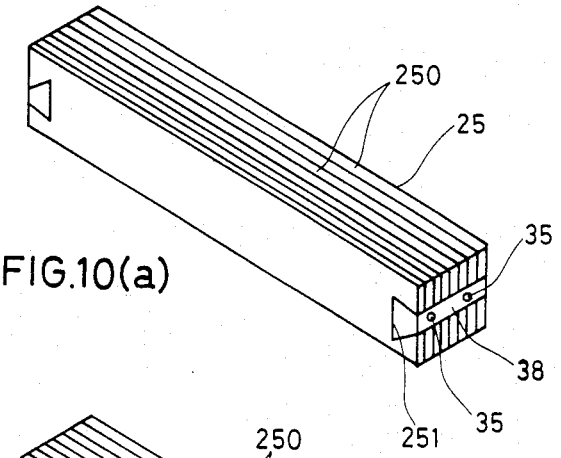
FIGS. 10(*a*) and 10(*b*) show perspective views of iron cores adapted for the device of FIG. 8.
Figure 10B:
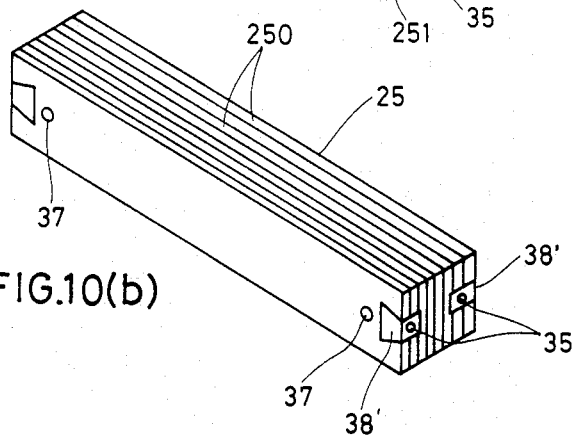

FIGS. 10(*a*) and 10(*b*) show the first iron core 25 suitable for the device of FIG. 8.

With reference to FIG. 10(*a*), the iron core 25 comprises a plurality of isolated thin magnetic plates 250 formed with two notches 251. The two notches 251 are positioned at the two sides. The notches 251 have a reverse-wedge shape. The notches 251 in the perspective plates 250 are aligned to form the reverse-wedge cavities. The blocks 38 are inserted into the cavities under pressure. The blocks 38 are made of a magnetic material or a heat-resisting resin. On the magnetic blocks 38, screw apertures 35 are provided for joining the screws from the third iron cores 27.

Since the cavities by the notches 251 are formed in the two sides of the plates 250, the plates 250 are exactly aligned and fixed.

With the help of the screws, the third iron cores 27 and the magnetic block 29 are fixed to the blocks 38, so that the first iron core 25 are combined with the third iron cores 27. The first iron core 25 and the third iron cores 27 are magnetically and mechanically engaged with each other with the help of the magentic blocks 29.

Since the magnetic flux for passing through the closed magnetic circuit is distributed within the width and the length of the magnetic plates 250, the connection between the iron cores 25, 26, and 27 do not disturb the flow of the magnetic flux.

FIG. 10(*b*) shows another preferred form of the first iron core 25.

With reference to FIG. 10(*b*), the iron core 25 comprises the thin plates 250 and insert blocks 38'. In the blocks 38', at least one aperture is formed for combining with the screw from the block 29. In the thin layers 250, apertures 37 are formed for combining some screws for combining and accurately aligning the thin layers 250.

It may be evident that the second iron core 26 has one or more blocks inserted within the second iron core 26 for combining with the third iron blocks 27.

While only certain embodiments of the present invention have been described, it will be apparent to those skilled in the art that various changes and modifications may be made therein without departing from the sprit and scope the present invention as claimed.

What is claimed is:

1. An induction heating and fixing device suitable for a copying machine comprising in combination at least one fixing roller for fixing a tone image onto a copy paper, said fixing roller having an electroconductive surface;

a first iron core means with respective ends inserted into a center of said at least one fixing roller comprising a coil means wound around said first iron core means;

a second iron core means positioned over said fixing roller substantially parallel to said first core means and having corresponding ends;

a set of third iron core means interposed between said respective ends of said first and second iron core means, said first, second and third iron core means being magnetically and mechanically connected to form a closed magnetic circuit around said fixing roller for induction heating of said surface of said fixing roller, said mechanical connection being such that said iron cores may be readily disassembled.

2. The device of claim 1, further comprising three magnetic block means for magnetically and mechanically combining said first, second, and third iron core.

3. The device of claim 1, wherein said first, second, and third iron core means comprise a plurality of insulated thin silicon steel plates.

4. The device of claim 1, wherein said fixing roller is coated with a synthetic resin.

5. The device of claim 4, wherein said synthetic resin is Teflon.

6. The device of claim 1, wherein said first, second, and third iron core means are combined by screw means.

7. The device of claim 1, wherein said second iron core means has a height less than that of said first iron core means, and said second iron core means has a width greater than that of said first iron core means.

8. The device of claim 1, including a power source for said coil means, wherein said coil means comprises a first wiring and a second wiring, with a switch means provided for switching between said first and second wirings, the number of turns of said first wiring being greater than the number of turns of said second wiring, whereby said power source is connected to said second wiring via said switch means until said roller surface reaches said fixing temperature at which time said switch means is switched to said first wiring to reduce power consumed by said fixing device.

9. The device of claim 1, further comprising at least one block member inserted into at least a part of said respective ends of said first iron core, said at least one block member having an aperture therein for combining said first and third iron core means.

10. The device of claim 3, further comprising opening means in said first iron core means for combining the plurality of insulated thin plates together.

11. The device of claim 8, further including a temperature sensor for sensing the temperature of the surface of said fixing roller which enables switching of said switch means between said second wiring and said first wiring.

* * * * *